US009379496B2

(12) United States Patent
Hashimoto et al.

(10) Patent No.: US 9,379,496 B2
(45) Date of Patent: Jun. 28, 2016

(54) CONNECTOR WITH ELECTRONIC COMPONENT HOLDING PORTION

(71) Applicant: Sumitomo Wiring Systems, Ltd., Yokkaichi, Mie (JP)

(72) Inventors: Tsutomu Hashimoto, Yokkaichi (JP); Motohiro Ando, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 127 days.

(21) Appl. No.: 14/277,445

(22) Filed: May 14, 2014

(65) Prior Publication Data

US 2014/0357127 A1 Dec. 4, 2014

(30) Foreign Application Priority Data

May 30, 2013 (JP) ..... 2013-114152

(51) Int. Cl.
*H01R 13/66* (2006.01)
*H01R 31/08* (2006.01)

(52) U.S. Cl.
CPC ..... *H01R 13/6625* (2013.01); *H01R 31/08* (2013.01); *H01R 2201/26* (2013.01)

(58) Field of Classification Search
CPC ..... H01R 13/6625; H01R 13/6616; H01R 13/6658; H01R 13/7195
USPC ..... 439/620.09, 620.21, 620.13
See application file for complete search history.

(56) References Cited

U.S. PATENT DOCUMENTS

| | | | | |
|---|---|---|---|---|
| 6,572,412 | B2 * | 6/2003 | Beuther | H05K 5/0069 439/381 |
| 8,870,599 | B2 * | 10/2014 | Takemoto | H01R 13/6625 439/620.21 |
| 2012/0129392 | A1 | 5/2012 | Fujisaki | |
| 2013/0040504 | A1 * | 2/2013 | Takemoto | H01R 13/6625 439/694 |
| 2014/0220823 | A1 * | 8/2014 | Ando | H01R 13/6625 439/620.01 |
| 2014/0364009 | A1 * | 12/2014 | Kondo | H01R 13/6625 439/620.09 |
| 2015/0004841 | A1 * | 1/2015 | Fujiwara | H01R 13/6625 439/620.21 |

FOREIGN PATENT DOCUMENTS

| | | |
|---|---|---|
| JP | 2007-287644 | 11/2007 |
| JP | 2012-109158 | 6/2012 |

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A connector (10) includes a capacitor (30) with a capacitor main body (31) extending in a front-back direction and two lead wires (32) extending forward from the front end of the capacitor main body (31). Busbars (50, 60) are arranged before the capacitor (30) and have two electronic component connecting portions (55, 65) to be connected to the lead wires (32). The connector (10) also has a housing with a forwardly open insertion opening (21) into which the capacitor (30) and the busbars (50, 60) are insertable so that the busbars (50, 60) are held. An electronic component holding portion (43) is provided in the housing and includes resiliently deflectable pieces (44) that are configured to clamp the capacitor main body (31) in a deflected state.

12 Claims, 17 Drawing Sheets

CONNECTOR WITH ELECTRONIC COMPONENT HOLDING PORTION

BACKGROUND

1. Field of the Invention

The invention relates to a connector with an electronic component.

2. Description of the Related Art

Japanese Unexamined Patent Publication No. 2007-287644 discloses a connector with a built-in electronic component, such as a capacitor. The electronic component has a wide component main body, and two lead wires are drawn out in opposite directions from opposite ends of the component main body. The lead wires are soldered to busbars and are arranged to hold the component main body at both sides. Thus, even if the connector with the electronic component is subjected to vibration, the component main body of the electronic component does not vibrate a large amount and there is no possibility of breaking connecting parts with the busbars.

Japanese Unexamined Patent Publication No. 2012-109158 discloses an electronic component with two lead wires supported at one side and drawn out in the same direction from one end of a component main body. The component main body is sandwiched in a front-back direction between a receiving portion in a housing and a support on a holder and is sandwiched in a vertical direction between sandwiching pieces provided on busbars to avoid vibration of the component main body of the electronic component. However, the electronic components originally have large dimensional tolerances. Thus, a component main body with smaller dimensions may not be sandwiched in the front-back direction between the receiving portion of the housing and the support of the holder. Further, the sandwiching pieces of the respective busbars may not sandwich the component main body reliably in the vertical direction by for a similar reason.

The invention was completed based on the above situation and aims to reliably suppress the vibration of an electronic component in a connector.

SUMMARY OF THE INVENTION

The invention relates to a connector with an electronic component. The electronic component has a component main body extending in a front-back direction and two lead wires extending forward from the front end of the component main body. A conductive member is arranged before the electronic component and has two connecting portions to be connected to the lead wires. The connector also has a housing with an insertion opening that is open forward. The insertion opening is configured to receive the electronic component and the conductive member and to hold the conductive member. An electronic component holding portion is integral to the housing and has resiliently deflectable pieces that resiliently hold the electronic component.

Depending on the specification of the connector with the electronic component, the electronic component may adopt a vertical arrangement in which the component main body of the electronic component is arranged in the front-back direction (connecting direction to a mating connector) and is configured so that both lead wires are drawn out forward from the front end of the component main body. Thus, if the connector with the electronic component vibrates, a rear end (free end) of the component main body of the cantilevered electronic component would vibrate easily and connecting parts of the conductive member and the pair of electronic component connecting portions would brake easily.

Accordingly, the housing has the electronic component holding portion. Thus, the component main body of the electronic component is clamped and held by the resilient pieces of the electronic component holding portion. The resilient pieces suppress vibration of the rear end of the component main body and absorb a dimensional tolerance of the electronic component so that the connecting parts of the lead wires and the electronic component connecting portions will not break.

The component main body may be a substantially solid cylinder, and the resilient pieces may be arranged at substantially at equal intervals along the outer cylindrical surface of the component main body. Accordingly, the resilient pieces clamp the component main body in a well-balanced manner.

The housing may include a holder for holding the conductive member and a housing main body that includes the insertion opening and configured to accommodate the holder inserted through the insertion opening. Thus, the holder can be accommodated into the housing main body after the conductive member is held in the holder.

The electronic component holding portion and a rear end part of the holder may be formed integrally. Thus, the holder can be accommodated into the housing main body by connecting the lead wires to the respective conductive members after the conductive member and the electronic component are held in the holder.

The electronic component holding portion and a rear end part in the housing main body may be formed integrally. Accordingly, the component main body of the electronic component can be held directly by the housing main body.

DETAILED DESCRIPTION OF THE PREFERRED EMBODIMENTS

Figure 1:
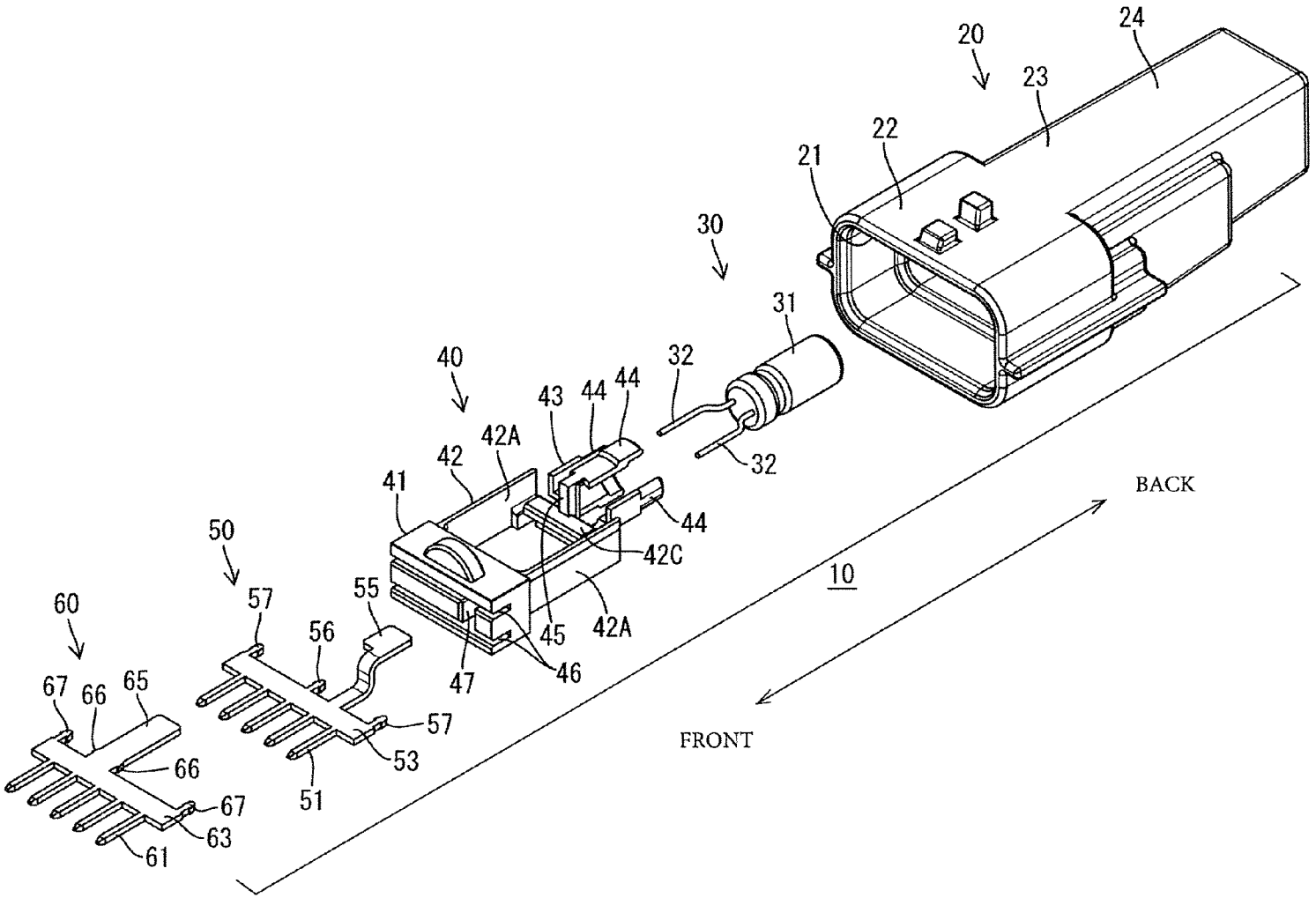
FIG. 1 is an exploded perspective view showing constituent elements of a connector with an electronic component according to a first embodiment.
Figure 2:
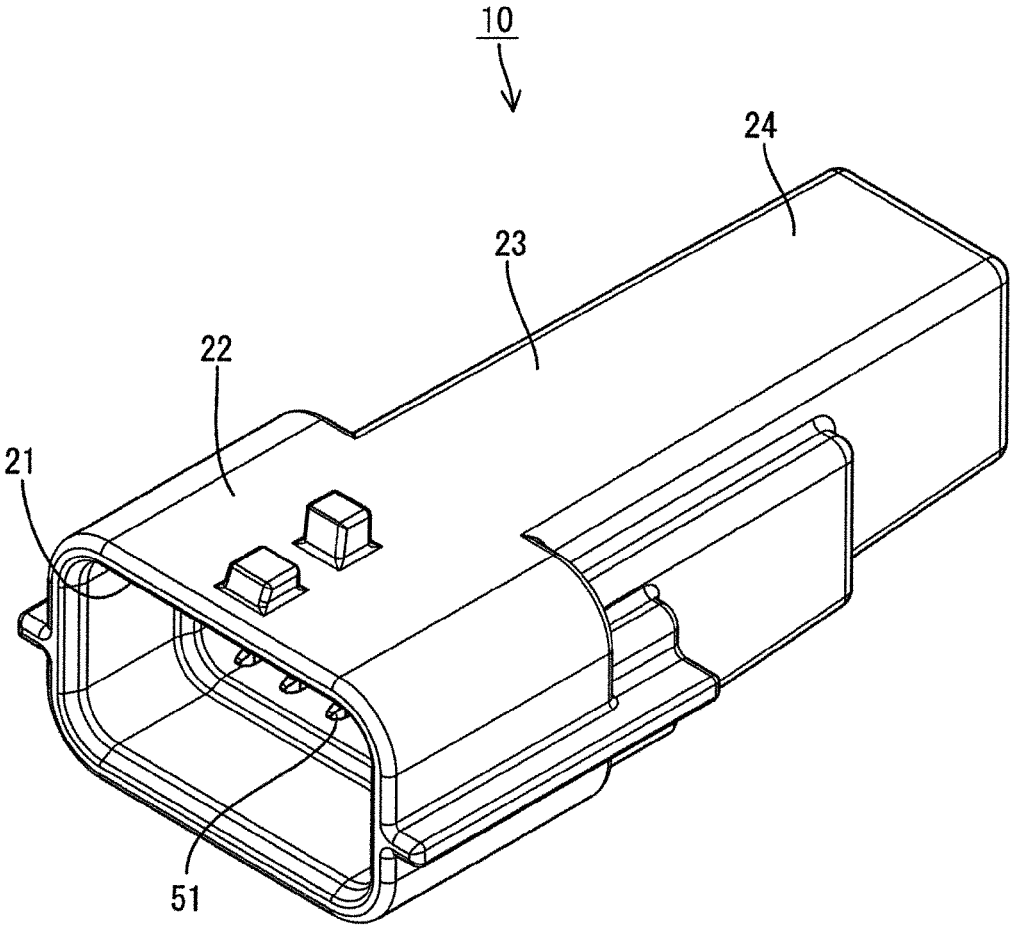
FIG. 2 is a perspective view of the connector with the electronic component when obliquely viewed from front.

A connector in accordance with a first embodiment of the invention is illustrated in FIGS. 1 to 15 and is identified by the numeral 10. The connector 10 is a joint connector for collectively connecting unillustrated wires drawn out from electric/electronic devices installed in an automotive vehicle and has an electronic component for removing noise of the electric/electronic devices. As shown in FIG. 1, the connector 10 includes a bag-shaped housing main body 20 open only in one direction, a capacitor 30, a holder 40, a first busbar 50 and a second busbar 60. Further, the connector 10 is connectable to an unillustrated mating connector. Note that, in the following description, a front-back direction is based on arrow directions in FIG. 1, wherein an end to be connected to the mating connector is referred to as a front end.

The housing main body 20 is made unitarily of synthetic resin and includes an insertion opening 21 that opens to a receptacle 22 for receiving the mating connector. A holder accommodating portion 23 is behind the receptacle 22 and a capacitor accommodating portion 24 is behind the holder accommodating portion 23. Thus, the housing main body 20 is in the form of a bag with the insertion opening 21 and a three-step structure rearward of the insertion opening 21. The capacitor 30 and the holder 40 are insertable into the insertion opening 21 from the front so that the capacitor 30 is accommodated in the capacitor accommodating portion 24 and the holder 40 is accommodated in the holder accommodating portion 23.

The first and second busbars 50, 60 are formed by punching an electrically conductive metal plate material and applying bending and the like to punched-out pieces. Further, the first and second busbars 50, 60 are arranged in upper and lower levels in a thickness direction (height direction) of the holder 40. The first busbar 50 is arranged in the lower level of the holder 40, and the second busbar 60 is arranged in the upper level of the holder 40. When configurations common to the first and second busbars 50, 60 are described below, these busbars are collectively referred to as busbars 50, 60.

Figure 3:
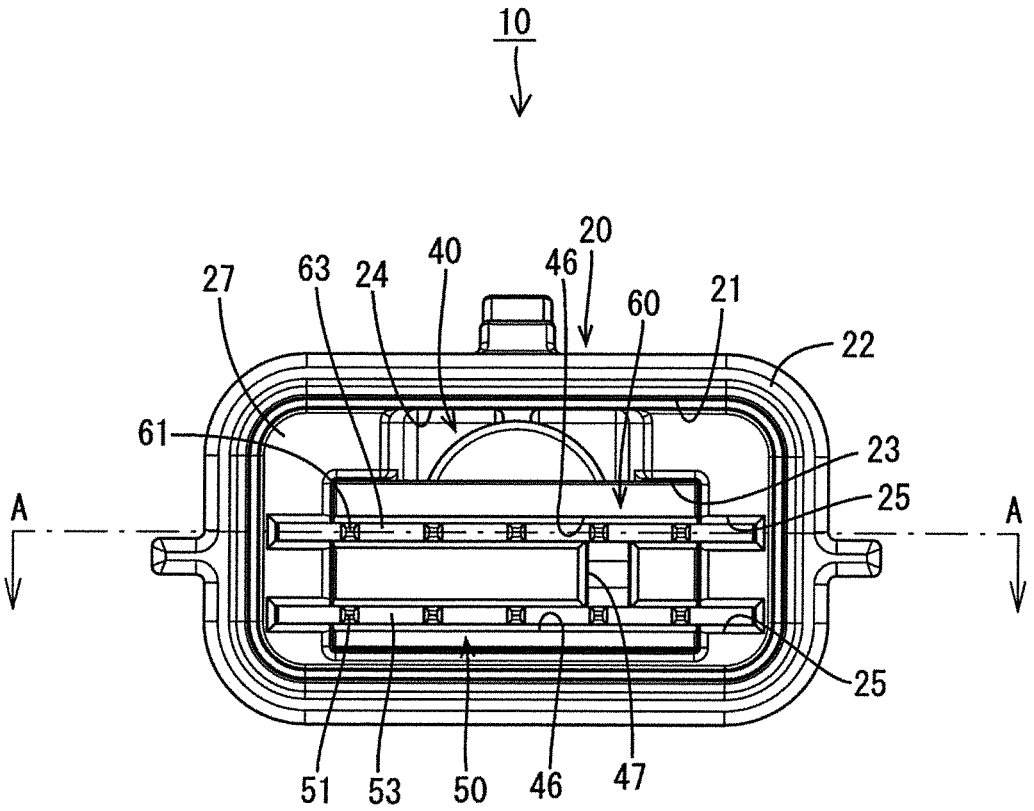
FIG. 3 is a front view of the connector with the electronic component.

Each busbar 50, 60 includes five terminals 51, 61 to be connected to female terminal fittings held in the mating connector, a strip-like coupling 53, 63 that couples the terminals 51, 61 in a comb-teeth manner, and an electronic component connecting portion 55, 65 to be connected to the capacitor 30. The respective terminals 51, 61 are arranged at vertically aligned positions, as shown in FIG. 3.

The terminals 51, 61 are in the form of tabs and project side by side at constant intervals on the front end surface of the strip-like coupling 53, 64. As shown in FIG. 1, the electronic component connecting portion 55, 65 is formed on the rear end surface of the strip-like coupling 53, 63 opposite to the terminals 51, 61 and extends backward.

Figure 7:
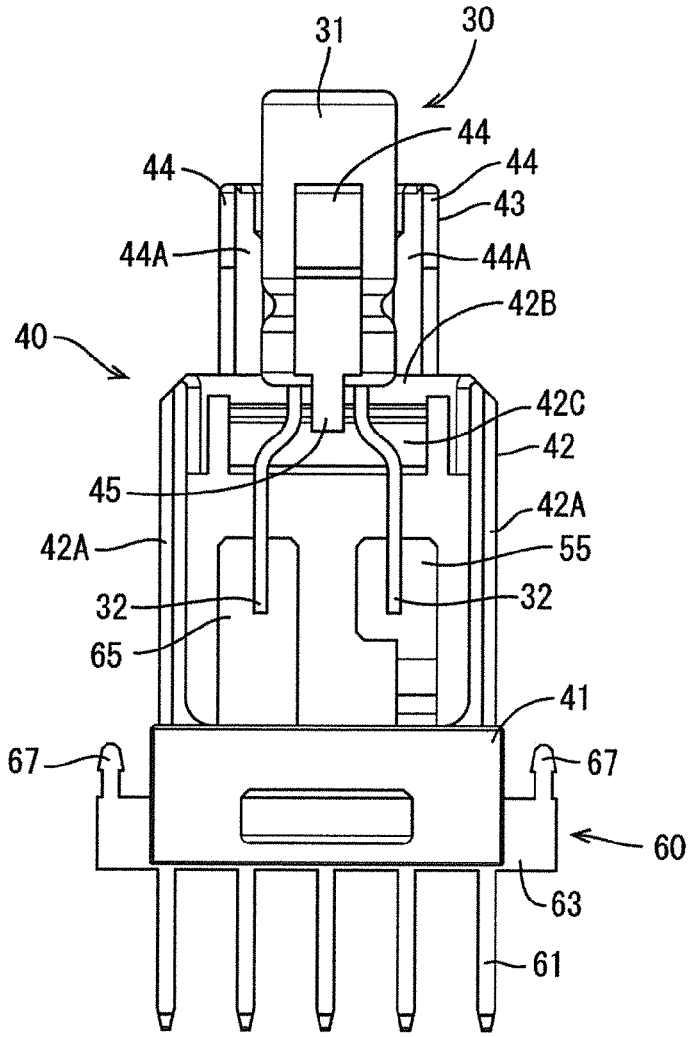
FIG. 7 is a plan view showing the state where the capacitor and the busbar pieces are held in the holder.
Figure 8:
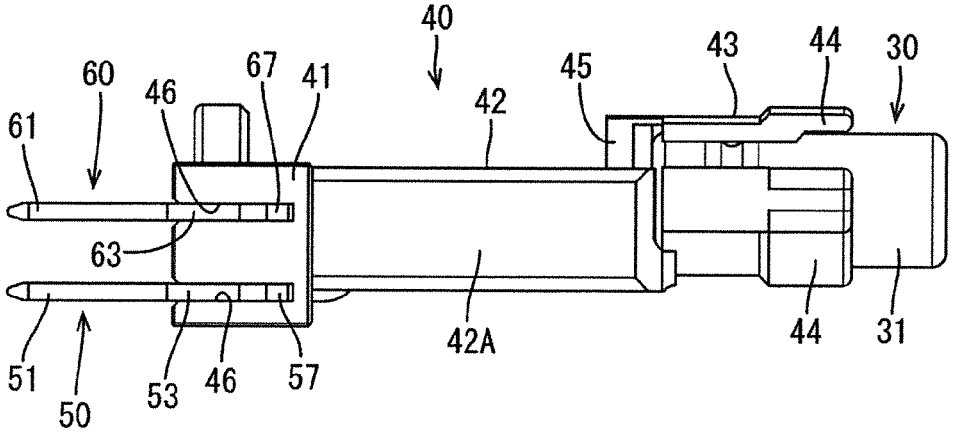
FIG. 8 is a side view showing the state where the capacitor and the busbar pieces are held in the holder.

As shown in FIG. 7, lateral lengths of the strip-like couplings 53, 63 are longer than a widthwise length of a later-described busbar holding portion 41 of the holder 40. Thus, when the busbars 50, 60 are mounted into the holder 40, the strip-like couplings 53, 64 project from opposite left and right ends of the busbar holding portion 41.

The electronic component connecting portion 55 of the first busbar 50 and the electronic component connecting portion 65 of the second busbar 60 are arranged at a fixed distance from each other in a width direction of the holder 40, as shown in FIG. 7 when being mounted.

Figure 4:
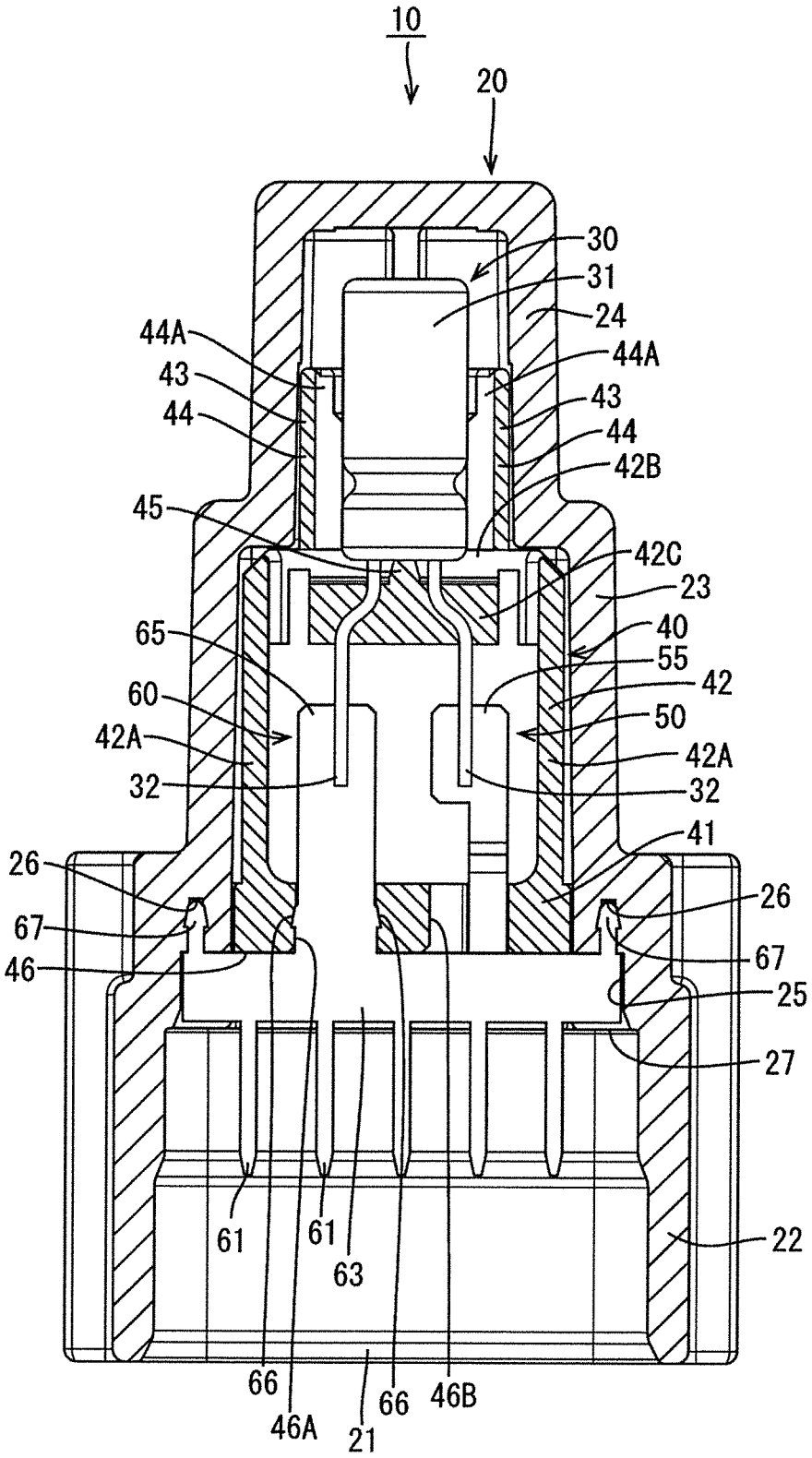
FIG. 4 is a section along A-A of FIG. 3.

As shown in FIG. 4, the electronic component connecting portion 65 of the second busbar 60 projects back from a position of the strip-like coupling 63 displaced to the left from a center in the lateral direction of the holder 40. Further, since there is no step between the electronic component connecting portion 65 and the strip-like coupling 63, the entire second busbar 60 is flat. Note that a width of the electronic component connecting portion 65 is substantially constant over the entire length.

Second press-fit portions 66 are formed on a front end part of the electronic component connecting portion 65 of the second busbar 60 and are wider toward the front. Thus, larger parts bite into resin as the second press-fit portions 66 are press-fit into second connecting portion insertion holes 46B to be described later. Specifically, a wedge-shaped press-fit portion is formed by combining two second press-fit portions 66 on opposite left and right sides of the electronic component connecting portion 65. As shown in FIG. 4, the second press-fit portions 66 function to retain and hold the second busbar 60 arranged at a predetermined position in the holder 40 by being locked substantially in a central part of the busbar holding portion 41 in the front-back direction.

As shown in FIG. 1, the electronic component connecting portion 55 of the first busbar 50 projects back from a position displaced to the right from a lateral center of the strip-like coupling 53.

The electronic component connecting portion 55 of the first busbar piece 50 is bent at a right angle twice at intermediate positions in a front-back direction so that a tip thereof is at substantially the same height as the electronic component connecting portion 65 of the second busbar 60. Specifically, the electronic component connecting portion 55 is bent backward at the same height as the electronic component connecting portion 65 of the second busbar 60 after being bent up at an intermediate position in the length direction. Further, the tip of the electronic component connecting portion 55 of the first busbar 50 is slightly wider than a bent part.

As shown in FIG. 1, the first busbar 50 includes a first press-fit portion 56 to be press-fit into a holder press-fit hole 64A in the holder 40. The first press-fit portion 56 projects toward the same side of the strip-like coupling 53 as the electronic component connecting portion 55 and hence from a side opposite to the terminals 51. A length of the first press-fit portion 56 is shorter than a length of the busbar piece holding portion 41 in the front-back direction. Further, a tip of the first press-fit portion 56 is wedge-shaped. The offset position of the first press-fit portion 56 from the bent electronic component connecting portion 55 ensures that a press-fitting force will not deform the bent position to deform the electronic component connecting portion 55.

The busbars 50, 60 also include housing press-fit portions 57, 67 to be press-fit into housing press-fit holes 26 in the housing main body 20. The housing press-fit portions 57, 67 project from the same side of the strip-like coupling 53, 63 as the electronic component connecting portion 55, 65 and hence from the side opposite the terminals 51, 61. Lengths of the housing press-fit portions 57, 67 substantially equal lengths of the first and second press-fit portions 56, 66, and tips thereof are wedge-shaped. Further, the housing press-fit portions 57, 67 are on opposite ends of the strip-like coupling portion 53, 63 in the lateral direction. The housing press-fit portions 57, 67 project to both left and right sides from the busbar holding portion 41 when the busbar piece 50, 60 is mounted into the holder 40.

The capacitor 30 is an aluminum electrolytic capacitor and includes a capacitor main body 31 formed into a substantially solid cylindrical shape. Positive and negative lead wires 32 project forward from the front end surface of the capacitor main body 31 and define round pins arranged at a predetermined distance from each other. The lead wires 32 are arranged above the electronic component connecting portions 55, 65 of the busbars 50, 60 by mounting the capacitor main body 31 into an electronic component holding portion 43 of the holder 40, and are connected to the electronic component connecting portions 55, 65 by resistance welding.

Figure 9:
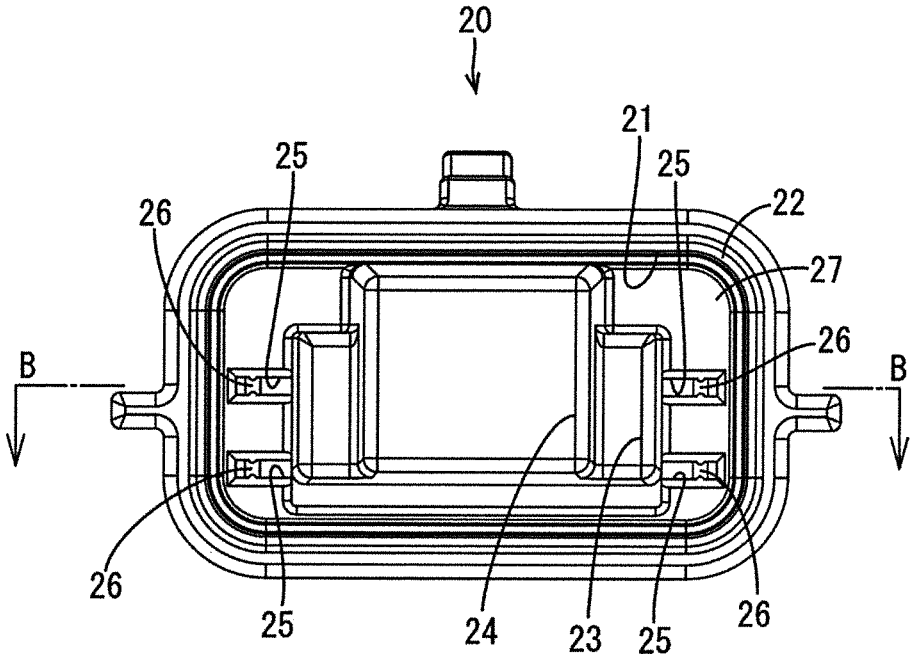
FIG. 9 is a front view of a housing main body.
Figure 10:
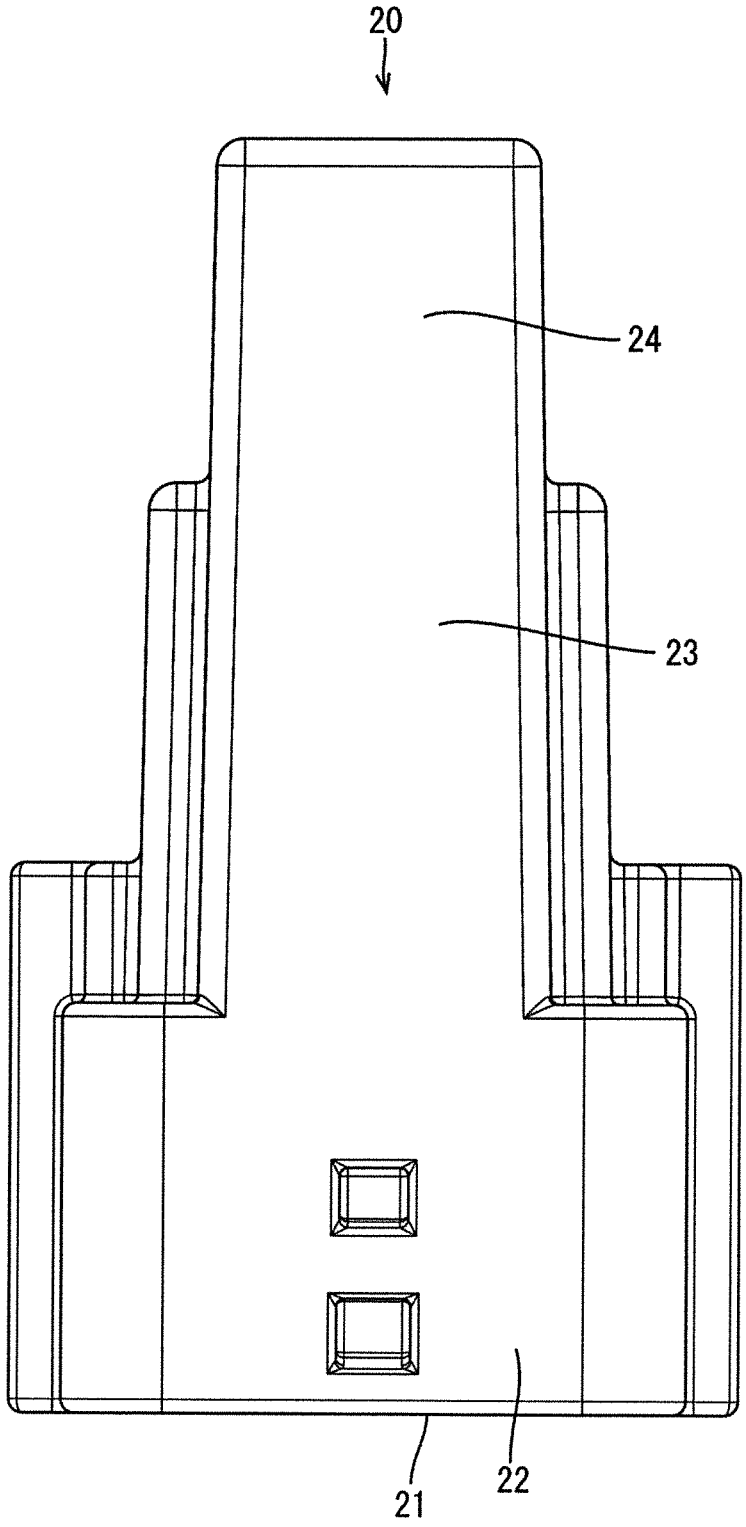
FIG. 10 is a plan view of the housing main body.
Figure 11:
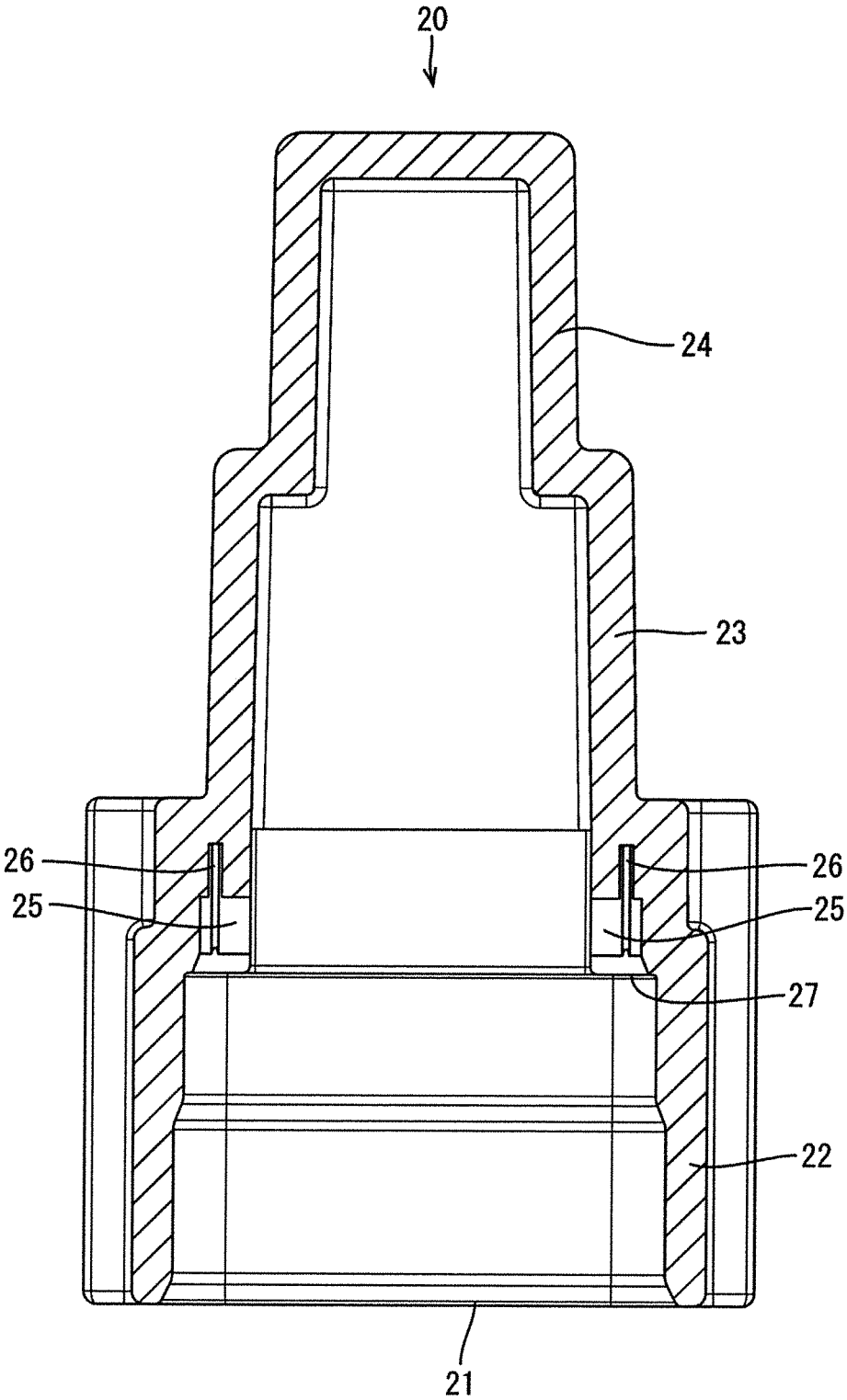
FIG. 11 is a section along B-B of FIG. 9.

The receptacle 22 of the housing main body 20 has a connection bottom surface 27 that is recessed back to form the capacitor accommodating portion 24, as shown in FIGS. 9 and 11. Additionally, the connection bottom surface 27 is recessed to have a larger opening than the capacitor accommodating portion 24, thereby forming the holder accommodating portion 23. Housing insertion grooves 25 are formed in a coupling part of the receptacle 22 and the holder accommodating portion 23 and can receive opposite end parts of the strip-like couplings 53, 63 of the busbars 50, 60. Two housing insertion grooves 25 are arranged on opposite left and right sides of the holder accommodating portion 23, and rear ends of the housing insertion grooves 25 are recessed to form rearward extending housing press-fit holes 26. Upper and lower ribs are formed in the housing press-fit holes 26 and the busbars 50, 60 are held in the housing main body 20 while being positioned vertically and squeezed by the ribs at the time of press-fitting.

The holder accommodating portion 23 is sized to accommodate an intermediate portion 42 of the holder 40 therein without looseness. On the other hand, the capacitor accommodating portion 24 can accommodate the electronic component holding portion 43 of the holder 40, as shown in FIG. 4. The capacitor accommodating portion 24 has a length sufficient to provide a space on a rear end of the capacitor accommodating portion 24 when the electronic component holding portion 43 is at a predetermined position.

Figure 5:
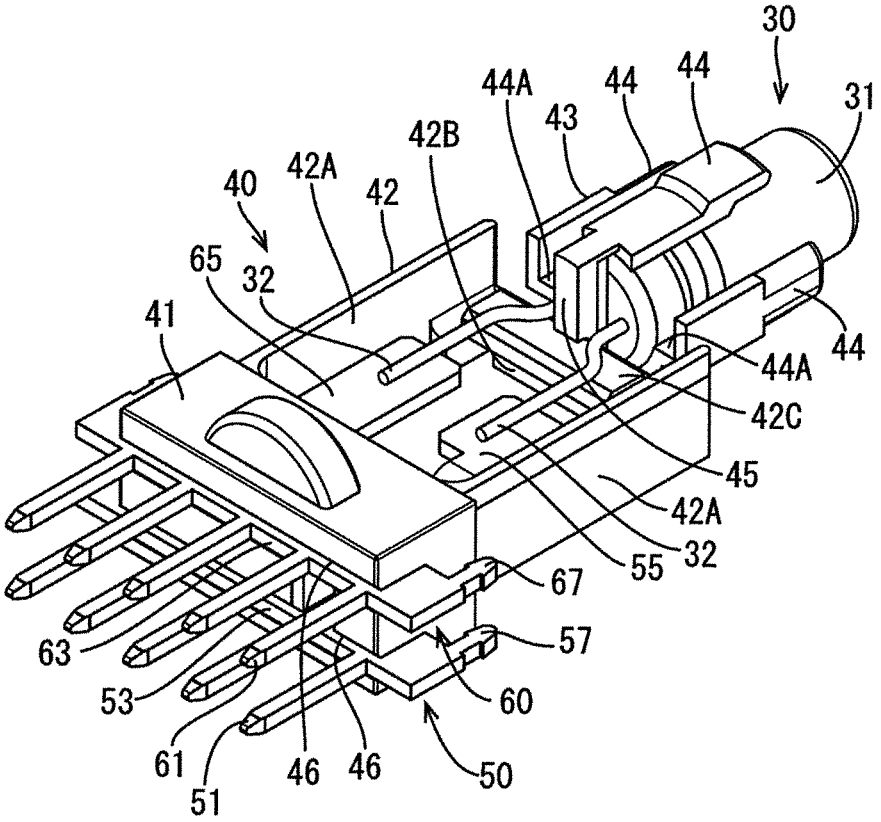
FIG. 5 is a perspective view showing a state where a capacitor and busbar pieces are held in a holder when obliquely viewed from front.
Figure 6:
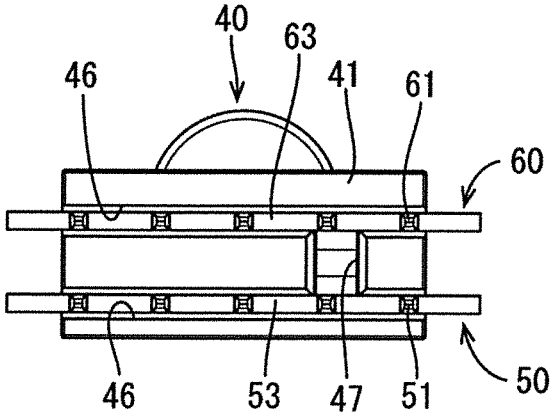
FIG. 6 is a front view showing the state where the capacitor and the busbar pieces are held in the holder.

The holder 40 is formed unitarily of synthetic resin and, as shown in FIG. 5, is long and narrow in the front-back direction. The busbar holding portion 41 is formed on the front part of the holder 40 for holding the busbars 50, 60 and the electronic component holding portion 43 is formed on the rear part of the holder 40 for holding the capacitor 30. The busbars 50, 60 and the capacitor 30 are connected in the intermediate portion 42 between the busbar holding portion 41 and the electronic component holding portion 43 of the holder 40. Note that the electronic component holding portion 43 is substantially in a widthwise center of the holder 40.

As shown in FIGS. 5 and 7, the intermediate portion 42 has side walls 42A that face each other in the width direction, an intermediate coupling 42B that couples the side walls 42A and a lead wire support 42C for supporting the lead wires 32. The side walls 42A are substantially parallel and the front ends thereof are coupled to the busbar holding portion 41. The intermediate coupling 42B couples rear ends of the side walls 42A to each other and also is coupled to the electronic component holding portion 43.

The lead wire support 42C for supporting the lead wires 32 of the capacitor 30 is provided on the front end of the intermediate coupling 42B. The lead wire support 42C is cantilevered forward from the intermediate coupling 42B and is resiliently deformable in the vertical direction. A space in the intermediate portion 42 enclosed by the side walls 42A, the busbar holding portion 41 and the electronic component holding portion 43 is open in the vertical direction so that the electronic component holding portion 43 and electrodes (not shown) for resistance-welding the lead wires 32 can be arranged.

Figure 12:
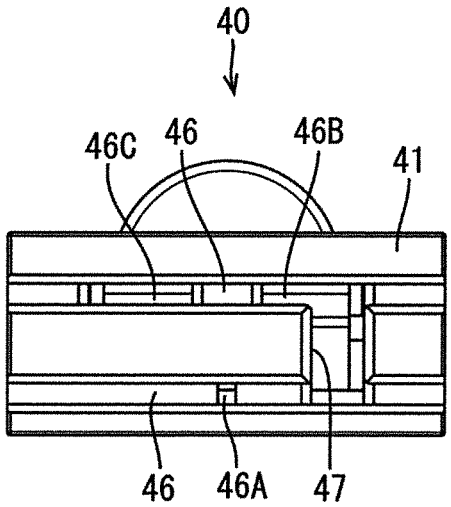
FIG. 12 is a front view of the holder.

As shown in FIG. 5, the busbar holding portion 41 is a substantially rectangular block long in the width direction of the holder 40. As shown in FIG. 12, the busbar holding portion 41 has mounting grooves 46 into which the strip-like couplings 53, 63 of the busbars 50, 60 are to be mounted. The mounting grooves 46 are open in a forward direction and left and right directions, and the strip-like couplings 53, 63 of the busbars 50, 60 are mountable therein from front. The busbar pieces 50, 60 are stopped at rear end positions by the rear end surface of the strip-like couplings 53, 63 contacting the rear surfaces of the mounting grooves 46 when being mounted, as shown in FIG. 5. Further, the mounting grooves 46 are formed in upper and lower levels in the busbar holding portion 41.

As shown in FIG. 12, a second connecting portion insertion hole 46B penetrates the back surface of the mounting groove 46 in the upper level and receives the electronic component connecting portion 65 of the second busbar 60. The electronic component connecting portion 65 is inserted into the mounting groove 46 from the front and projects into the intermediate portion 42 through the second connecting portion insertion hole 46B. Note that a width of the second connecting portion insertion hole 46B is substantially equal to that of the electronic component connecting portion 65. The second busbar 60 is press-fit and held in the mounting groove 46 of the holder 40 while being positioned in the vertical direction.

The busbar holding portion 41 is formed with an insertion hole 47 allowing the mounting grooves 46 in the upper and lower levels to communicate in the vertical direction. The insertion hole 47 enables insertion of the electronic component connecting portion 55 of the first busbar 50. The insertion hole 47 is slightly wider than the bent part of the electronic component connecting portion 55. Further, a first connecting portion insertion hole 46C penetrates the back surface of the mounting groove 46 in the upper level and the electronic component connecting portion 55 of the first busbar piece 50 is insertable therein. A tip of the electronic component connecting portion 55 is inserted into the mounting groove 46 in the upper level from the front and projects into the intermediate portion 42 through the first connecting portion insertion hole 46C, as shown in FIG. 4. At that time, the bent part is inserted into the insertion hole 47. Note the first connecting portion insertion hole 46C is wider than the insertion hole 47 and enables the insertion of the wide tip part of the electronic component connecting portion 55.

As shown in FIG. 12, a holder press-fit hole 46A is formed at a position corresponding to the first press-fit portion 56 of the first busbar 50 on the back surface of the mounting groove 46 in the lower level. The holder press-fit hole 46A is formed in a substantially widthwise center of the holder 40 and penetrates to a rear side of the busbar holding portion 41. Note that the first busbar 50 is press-fit and held in the mounting groove 46 of the holder 40 while being positioned in the vertical direction.

As shown in FIG. 1, the electronic component holding portion 43 includes resilient pieces 44 and a spacer 45. As shown in FIG. 5, the resilient pieces 44 surround the capacitor main body 31 and are arranged at equal intervals with an axis passing through the capacitor main body 31 in the front back direction as a center. The resilient pieces 44 deflect radially out with respect to the axis of the capacitor main body 31 when the capacitor 30 is mounted and suppresses vibration from outside while absorbing a dimensional tolerance of the capacitor main body 31, thereby avoiding breakage of the connecting parts of the lead wires 32 and the electronic component connecting portions 55, 65.

Figure 13:
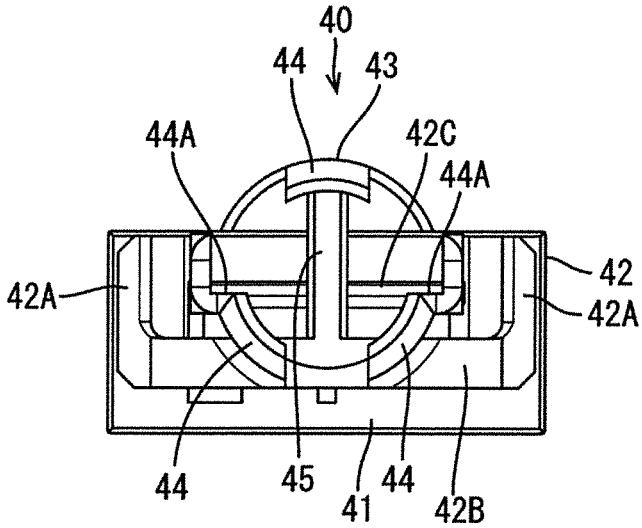
FIG. 13 is a rear view of the holder.
Figure 14:
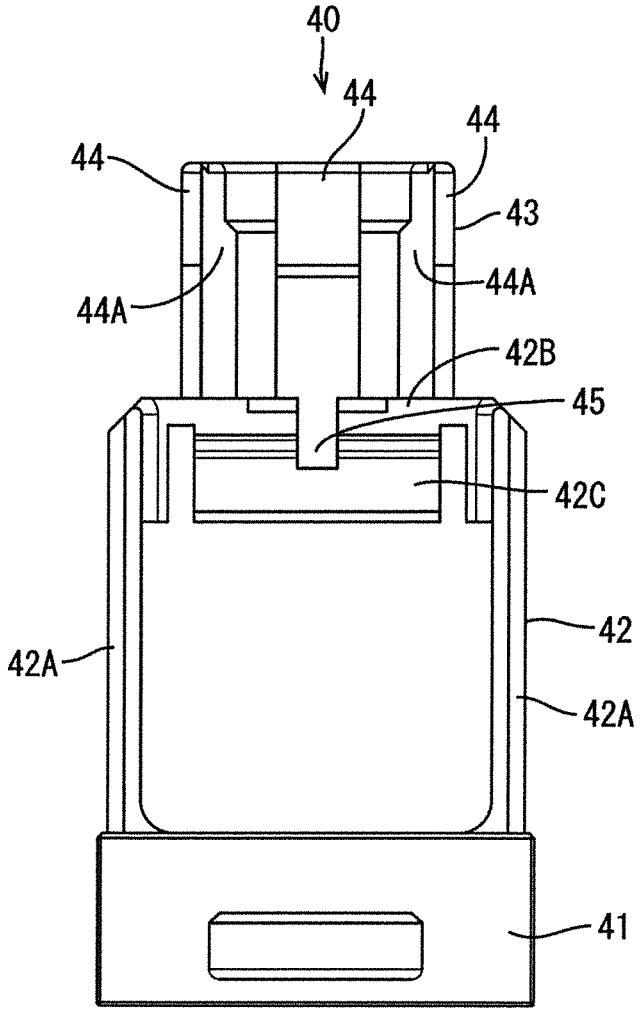
FIG. 14 is a plan view of the holder.
Figure 15:
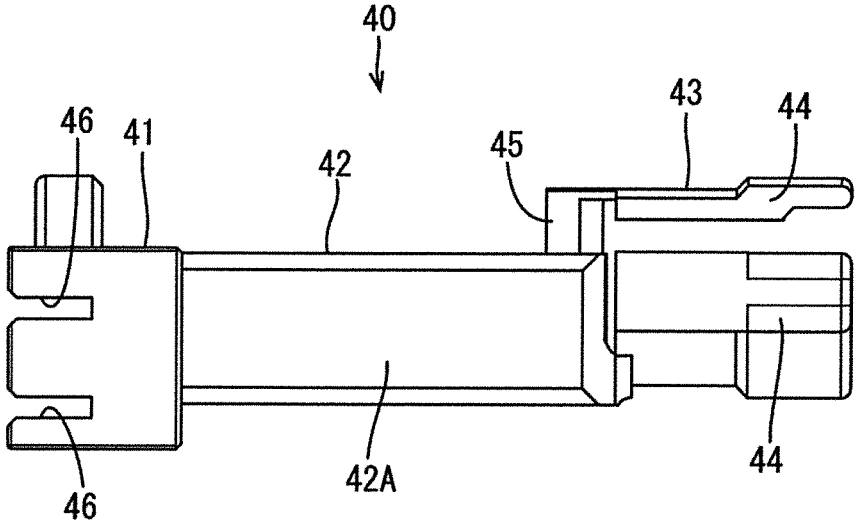
FIG. 15 is a side view of the holder.
Figure 16:
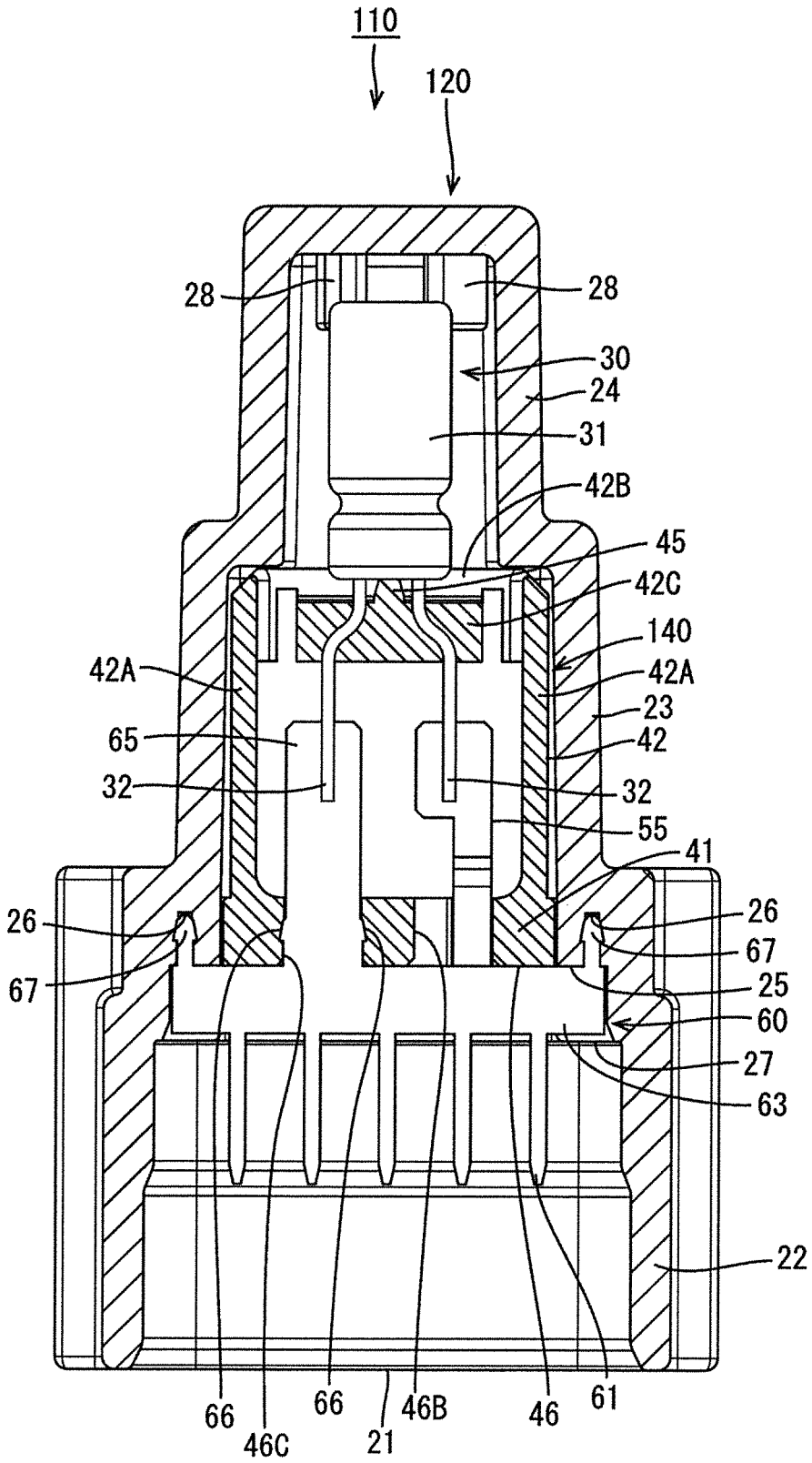
FIG. 16 is a section showing an internal structure of a connector with an electronic component according to a second embodiment.

The resilient pieces 44 are arranged to form a substantially hollow cylindrical shape and are arranged substantially at equal intervals along the outer peripheral surface of the capacitor main body 31 when the capacitor main body 31 is mounted. Further, as shown in FIG. 13, the resilient pieces 44 on opposite left and right sides are unitary with the intermediate coupling 42B, whereas the resilient piece 44 in the center is coupled to the intermediate coupling 42 via the spacer 45. The spacer 45 has a column shape and rises up from a substantially widthwise center of the intermediate coupling 42B, and the resilient piece 44 located in the center is coupled to an upper end of the spacer 45. The spacer 45 is arranged between the lead wires 32 to prevent mutual contact of the lead wires 32.

Upper ends of the resilient pieces 44 on the opposite left and right sides are offset out in the width direction to form steps 44A. Two steps 44A on the opposite left and right sides face each other, and the two lead wires 32 are passed through these steps 44A when the capacitor 30 is mounted into the electronic component holding portion 43 from behind. In a state where each lead wire 32 is passed through the corresponding step 44A, the capacitor main body 31 is positioned in a circumferential direction with rotation thereof suppressed. Thus, when the capacitor 30 is mounted, the tips of the lead wires 32 are not damaged by colliding with rear end parts of the electronic component connecting portions 55, 65 from behind.

The connector is assembled by initially mounting the first busbar 50 into the holder 40. The first busbar 50 is pushed back so that the strip-like coupling 53 is in the mounting groove 46 in the lower level, the bent part of the electronic component connecting portion 55 is in the insertion hole 47 and the wide part of the electronic component connecting portion 55 is in a front end of the first connecting portion insertion hole 46C of the mounting groove 46 in the upper level. The first press-fit portion 56 then is press-fit into the holder press-fit hole 46A of the mounting groove 46 in the lower level and the wide part of the electronic component connecting portion 55 projects into a hollow part of the intermediate portion 42. The pushing of the first busbar 50 is stopped when the rear end surface of the strip-like coupling 53 contacts the back surface of the mounting groove 46 in the lower level. Note that the electronic component connecting portion 55 is not press-fit when being inserted into the insertion hole 47 and the first connecting portion insertion hole 46C, and only the first press-fit portion 45 is press-fit. In this way, the first busbar piece 50 is held in the busbar piece holding portion 41 by the first press-fit portion 56 biting into the inner peripheral surface of the holder press-fit hole 46A.

Subsequently, the second busbar piece 60 is mounted into the holder 40. The second busbar piece 60 is pushed backward in such a manner that the strip-like coupling portion 63 is located in the mounting groove 46 in the upper level and the electronic component connecting portion 65 is located in a front side of the second connecting portion insertion hole 46B. Then, the second press-fit portions 66 of the electronic component connecting portion 65 are press-fit into the second connecting portion insertion hole 46B and a tip part of the electronic component connecting portion 65 projects into the hollow part of the intermediate portion 42. When the rear end surface of the strip-like coupling portion 63 comes into contact with the back surface of the mounting groove 46 in the upper level, the pushing of the second busbar piece 60 is stopped. In this way, the second busbar 60 is held in the busbar holding portion 41 by the second press-fit portions 66 biting into the inner peripheral surface of the second connecting portion insertion hole 46B.

As just described, when the busbars 50, 60 are mounted into the holder 40, the opposite left and right sides of the housing press-fit portions 57, 67 and the strip-like couplings 53, 63 project to the both left and right sides from the busbar holding portion 41.

The capacitor 30 is mounted into the electronic component holding portion 43 after the busbars 50, 60 are mounted. The capacitor 30 is inserted into a space inward of the resilient pieces 44 forming a substantially hollow cylindrical shape from behind and further inserted so that the respective lead wires 32 pass through the corresponding steps 44A to contact the electronic component connecting portions 55, 65 from above while the resilient pieces 44 are deflected radially outwardly of the capacitor main body 31. The capacitor main body 31 is clamped resiliently from a radially outer side by the resilient pieces 44 when the capacitor 30 is mounted at the predetermined position. Thus, the lead wires 32 and the electronic component connecting portions 55, 65 are resistance-welded while being sandwiched between the upper and lower electrodes for resistance welding.

Subsequently, the holder 40 mounted with the busbars 50, 60 and the capacitor 30 is mounted into the housing main body 20. The holder 40 is inserted through the insertion opening 21 with the capacitor 30 in the lead. The busbars 50, 60 are pushed by pressing ends of the strip-like couplings 53, 63 that project from the holder 40. The housing press-fit portions 57, 67 of the busbars 50, 60 are press-fit into the housing press-fit holes 26. The rear end surfaces of the end parts of the strip-like couplings 53, 63 projecting from the holder 40 contact the rear surfaces of the housing insertion grooves 25. Thus, the pushing is stopped. When the pushing of the busbars 50, 60 is stopped, the holder 40 is arranged at a predetermined position in the housing main body 20 together with the busbars 50, 60. In this way, the busbars 50, 60 are held in the housing main body 20 by the housing press-fit portions 57, 67 biting into the inner peripheral surfaces of the housing press-fit holes 26. Further, the busbar pieces 50, 60 also are held in the holder 40, the housing main body 20 and the holder 40 are fixed via the busbars 50, 60.

As described above, the holder 40 has the electronic component holding portion 43. Thus, the capacitor main body 31 of the capacitor 30 can be clamped and held by the resilient pieces 44 of the electronic component holding portion 43. By doing so, vibration of the rear end of the capacitor main body 31 is suppressed while the dimensional tolerance of the capacitor 30 is absorbed by the resilient pieces 44. Therefore, connecting parts of the lead wires 32 and the electronic component connecting portions 55, 65 will not break.

The capacitor main body 31 may be a substantially solid cylinder, and the resilient pieces 44 may form a substantially hollow cylinder and be arranged substantially at equal intervals along the outer peripheral surface of the capacitor main body 31. Accordingly, the capacitor 30 can be held by clamping the capacitor main body 31 in a well-balanced manner by the plurality of resilient pieces 44.

The housing may be provided with the holder 40 for holding the busbars 50, 60 and the housing main body 20 including the insertion opening 21 and configured to accommodate the holder 40 inserted through the insertion opening 21. Accordingly, the holder 40 can be accommodated into the housing main body 20 after the busbars 50, 60 are held in the holder 40.

The electronic component holding portion 43 and a rear end part of the holder 40 may be formed integrally. Accordingly, after the busbars 50, 60 and the capacitor 30 are held in the holder 40, the lead wires 32 can be connected to the corresponding busbars 50, 60 and this holder 40 can be accommodated in the housing main body 20.

The electronic component holding portion 43 and a rear end part in the housing main body 20 may be formed integrally. Accordingly, the capacitor main body 31 of the capacitor 30 can be held directly by the housing main body 20.

A connector in accordance with a second embodiment of the invention is described with reference to FIGS. 16 to 20 and differs from the first embodiment in the way the capacitor is held in the connector. Components of the second embodiment that are the same as the first embodiment are not described again and merely are denoted by the same reference numerals. Components of the second embodiment that are not identical to the first embodiment are denoted by reference signs obtained by adding 100 to numerical parts of the reference signs of the first embodiment.

Figure 17:
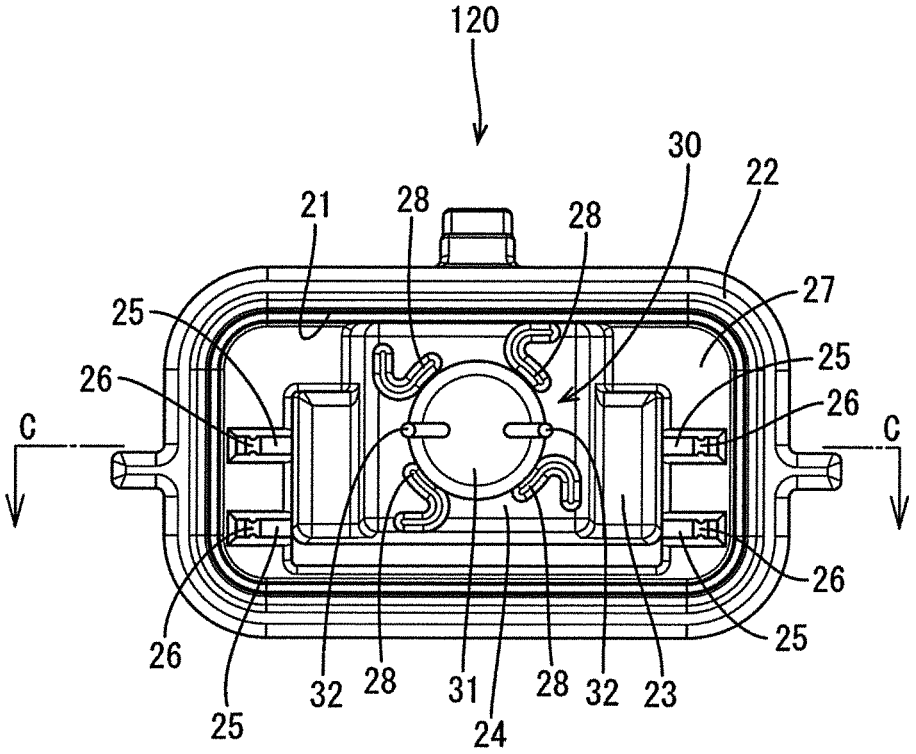
FIG. 17 is a front view showing a state where a capacitor is accommodated in a housing main body.
Figure 18:
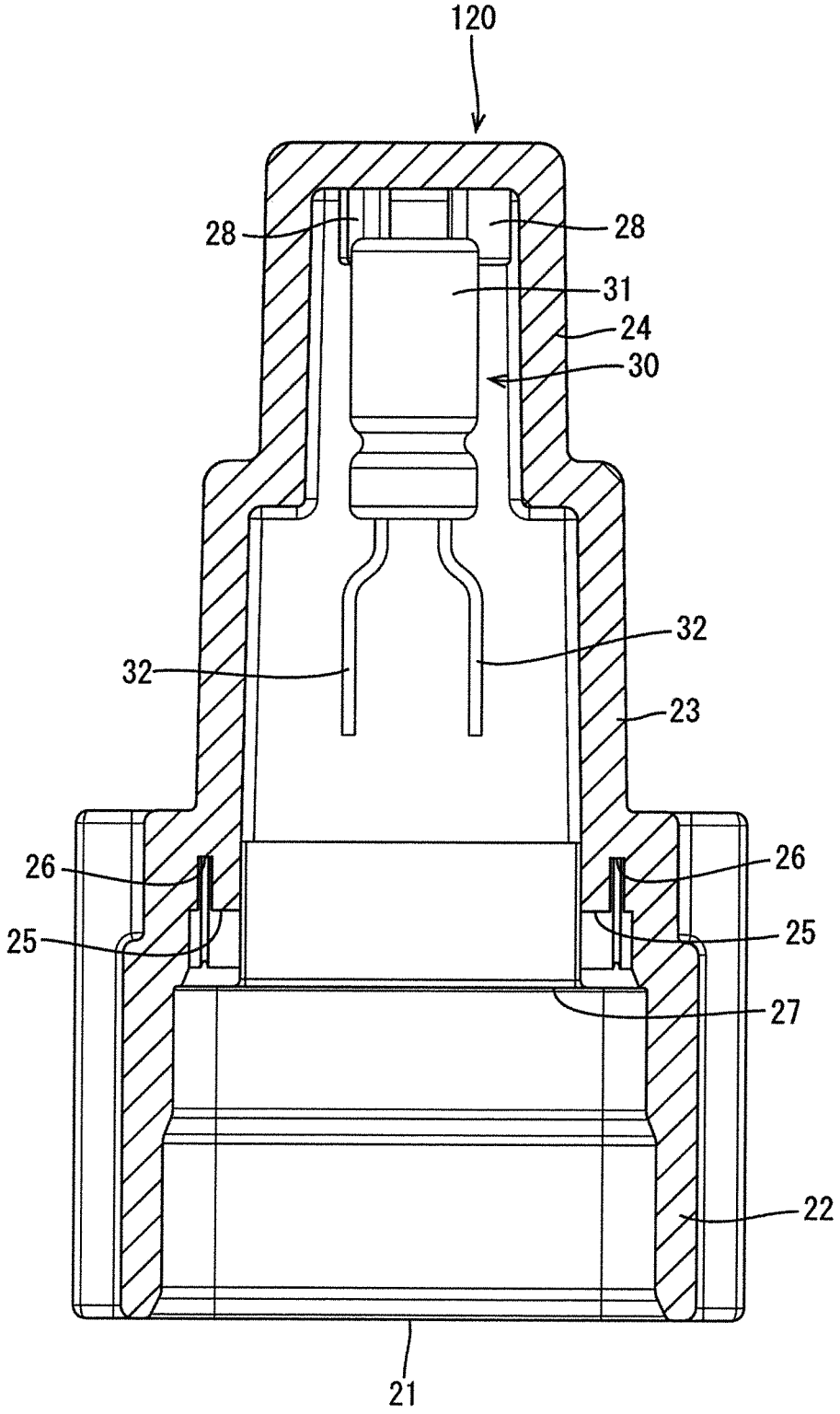
FIG. 18 is a section along C-C of FIG. 17.
Figure 19:
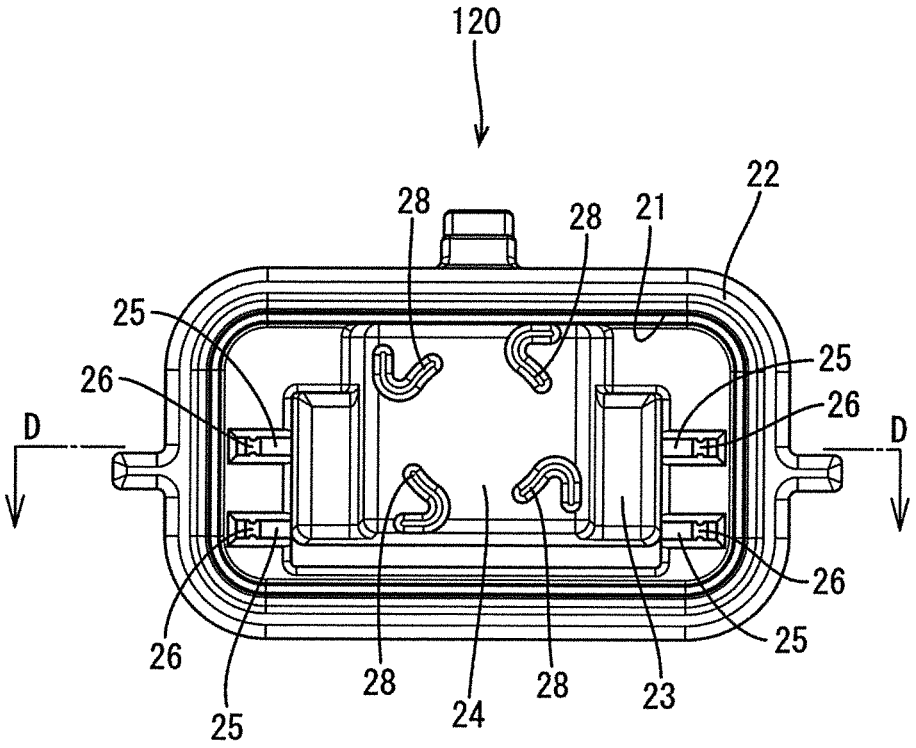
FIG. 19 is a front view of the housing main body.
Figure 20:
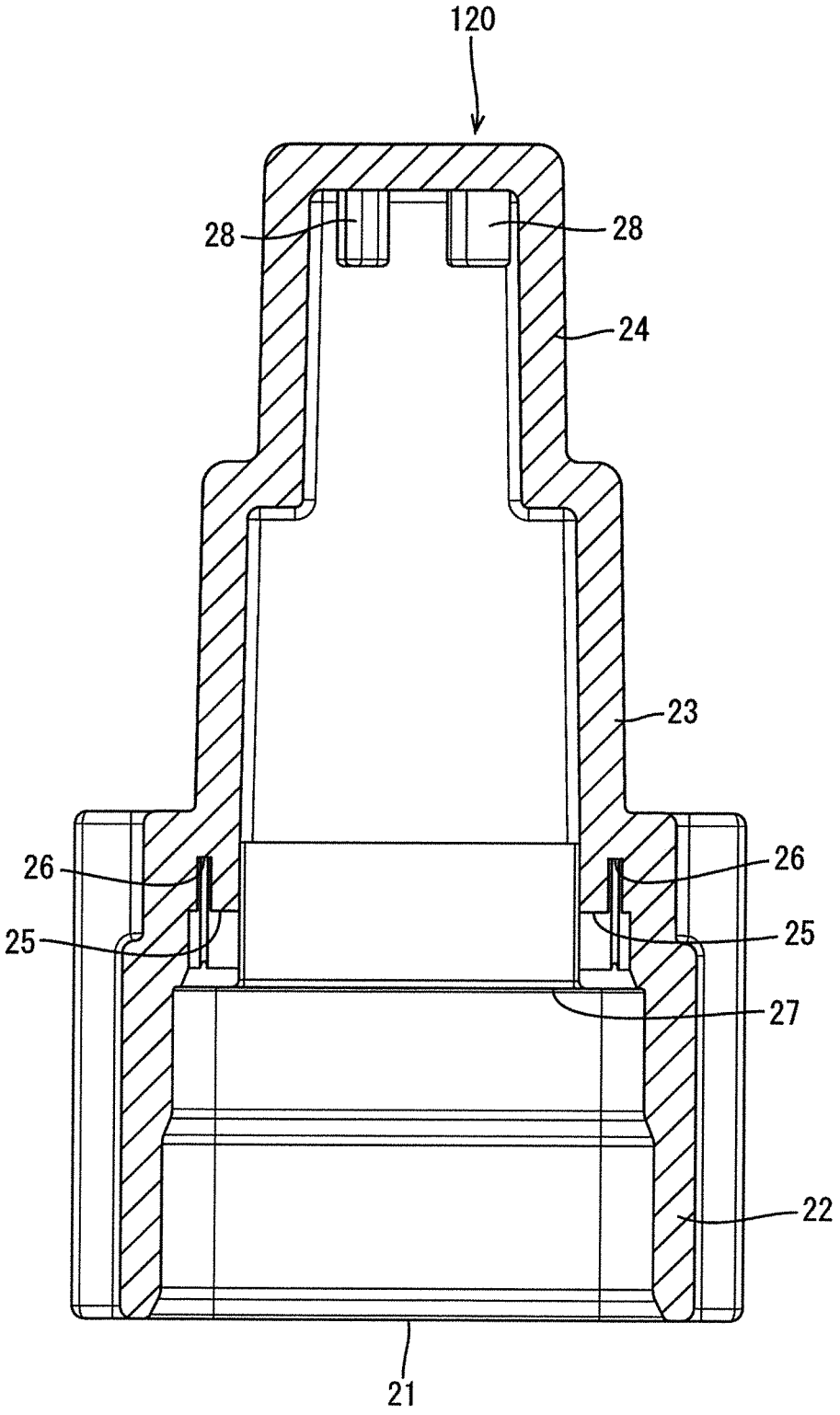
FIG. 20 is a section along D-D of FIG. 19.

The capacitor main body 31 is held by the electronic component holding portion 43 of the holder 40 in the first embodiment, whereas a capacitor main body 31 is held by resilient pieces 28 provided in a housing main body 120 in the second embodiment. As can be seen from FIG. 16, a holder 140 of this embodiment includes only a spacer 45 without including the resilient pieces 44. On the other hand, the housing main body 120 includes the resilient pieces 28 for resiliently clamping the capacitor main body 31. As shown in FIG. 17, the resilient pieces 28 are substantially V-shaped and arranged at substantially equal intervals along the outer peripheral surface of the capacitor main body 31 while facing in the same direction. Further, the resilient pieces 28 clamp the capacitor main body 31 in a state deflected radially outward of the capacitor main body 31.

The connector 110 of this embodiment is assembled by first connecting lead wires 32 to electronic component connecting portions 55, 65 by resistance welding and then inserting this holder 140 into a holder accommodating portion 23 through an insertion opening 21 of the housing main body 120. The capacitor main body 31 is pushed by the spacer 45 so that no load is applied to connecting parts of the lead wires 32 and the electronic component connecting portions 55, 65. Thereafter, the capacitor main body 31 is clamped by the respective resilient pieces 28 while deflecting these resilient pieces 28 radially outward. Accordingly, the capacitor main body 31 is held directly by the housing main body 120, so that the capacitor 30 is held more firmly.

The invention is not limited to the above described and illustrated embodiments. For example, the following embodiments also are included in the scope of the invention.

The electronic component holding portion has three or four resilient pieces 44, 28 in the illustrated embodiments. However, the number of the resilient pieces may be two, five or more according to the invention.

The capacitor 30 has a substantially solid cylindrical capacitor main body 31 in the illustrated embodiments. However, it may have a substantially rectangular column shape.

The housing is composed of the housing main body and the holder in the illustrated embodiments. However, a housing integrally formed with a housing main body and a holder may be used according to the invention.

The resilient pieces 44 are formed integrally to the rear end part of the holder 40 in the first embodiment and the resilient pieces 28 are formed integrally to the rear end part in the housing main body 120 in the second embodiment. However, the resilient pieces may be formed at any positions of the holder 40 in the first embodiment and at any positions of the housing main body 120 in the second embodiment.

Although the lead wires 32 of the capacitor 30 are in the form of round pins in the above embodiments, there is no limitation to this and the lead wires of the capacitor may be, for example, in the form of rectangular columns.

Although the electronic component is the capacitor 30 in the above embodiment, there is no limitation to this and the electronic component may be any one of various electronic components such as resistors and diodes.

What is claimed is:

1. A connector, comprising:

a housing main body extending in forward and backward directions and including a forwardly facing insertion opening;

an electronic component holder provided in the housing main body and including a plurality of circumferentially spaced resilient pieces extending in the forward and backward directions;

an electronic component including a component main body extending in the forward and backward direction held in the electronic component holding portion by the plurality of resilient pieces and lead wires extending forward from a front end of the component main body to positions forward of the electronic component holding portion; and a conductive member arranged forward of the component holding portion and formed with electronic component connecting portions connected to the lead wires.

2. The connector of claim 1, wherein the component main body has a substantially solid cylindrical shape, and the resilient pieces form loci of a cylinder and are arranged at substantially equal intervals along the outer peripheral surface of the component main body.

3. The connector of claim 1, wherein the resilient pieces and a rear end part of the holder are integral.

4. The connector of claim 1, wherein the resilient pieces and a rear end part in the housing main body are integral.

5. The connector of claim 1, further including a holder disposed in the housing main body and having an intermediate portion with a rear end defined by an intermediate coupling, and a spacer projecting from the intermediate coupling in a direction transverse to the forward and backward directions.

6. The connector of claim 5, wherein the holder includes a conductive member holding portion forward of the intermediate portion for holding the conductive member.

7. The connector of claim 6, wherein a portion of the conductive member projects rearward into the intermediate portion, and the lead wires of the electronic component project forward into the intermediate portion and are connected to the portion of the conductive member at the intermediate portion.

8. A connector, comprising:

a housing main body extending in forward and backward directions and including a forwardly facing insertion opening;

a holder provided in the main body, the holder including an intermediate portion having a rear end with an intermediate coupling and a spacer projecting from the intermediate coupling in a direction transverse to the forward and backward directions, an electronic component holding portion projecting rearward from the intermediate coupling, the electronic component holding portion including plural circumferentially spaced resilient pieces extending rearward from the spacer;

an electronic component including a component main body extending in forward and backward directions held in the electronic component holding portion and lead wires extending forward from the front end of the component main body disposed in the intermediate portion; and a conductive member arranged in the housing main body between the insertion opening and the component main body and formed with electronic component connecting portions connected to the lead wires.

9. The connector of claim 8, wherein the component main body has a substantially solid cylindrical shape.

10. The connector of claim 8, wherein the holder includes a conductive member holding portion forward of the intermediate portion for holding the conductive member.

11. The connector of claim 10, wherein a portion of the conductive member projects rearward into the intermediate portion, and the lead wires of the electronic component project forward into the intermediate portion and are connected to the portion of the conductive member at the intermediate portion.

12. A connector, comprising:

an electronic component holder having opposite front and rear ends, a plurality of resilient pieces formed at the rear end of the electronic component holder, a conductive member holding portion at the front end of the electronic component holder and an intermediate portion between the resilient pieces and the conductive member holding portion;

an electronic component having opposite front and rear ends, a component main body at the rear end of the electronic component and held resiliently by the resilient pieces of the electronic component holder and lead wires extending forward from a front end of the component main body to the intermediate portion of the electronic component holder;

at least one conductive member held in the conductive member holding portion of the electronic component holder and formed with electronic component connecting portions projecting rearward to the intermediate portion and connected to the lead wires; and a housing main body including a forwardly facing insertion opening into which the electronic component, the electronic component holder and the conductive member are inserted with the housing main body holding the conductive member while protectively surrounding the electronic component.

* * * * *